United States Patent [19]

Jacobs

[11] Patent Number: 4,574,787

[45] Date of Patent: Mar. 11, 1986

[54] ACUPRESSURE APPARATUS

[76] Inventor: H. Barry Jacobs, 11607 Foxclove Rd., Reston, Va. 22091

[21] Appl. No.: 408,003

[22] Filed: Aug. 13, 1982

[51] Int. Cl.[4] ..... A61H 7/00

[52] U.S. Cl. ..... 128/64; 128/380; 128/24.2; 128/32

[58] Field of Search ..... 128/24.1, 32, 36, 64, 128/380, 24.2; 604/303

[56] References Cited

U.S. PATENT DOCUMENTS

| | | | |
|---|---|---|---|
| 785,391 | 3/1905 | Weis | 128/24.1 X |
| 1,007,636 | 10/1911 | Beck | 128/66 X |
| 1,627,523 | 5/1927 | Morris | 604/303 X |
| 1,627,618 | 5/1927 | Paul | 604/303 X |
| 1,705,467 | 3/1929 | Battenfeld | 604/303 X |
| 3,028,857 | 4/1962 | Parker | 128/24.1 |
| 3,195,539 | 7/1965 | Hyman | 604/303 X |
| 3,323,517 | 6/1967 | Keller | 128/24.1 |
| 4,125,112 | 11/1978 | Weihs | 128/64 X |
| 4,231,355 | 11/1980 | Hara | 128/24.2 |

FOREIGN PATENT DOCUMENTS

| | | | |
|---|---|---|---|
| 874984 | 4/1959 | United Kingdom | 128/380 |

*Primary Examiner*—Richard J. Apley
*Assistant Examiner*—David J. Brown
*Attorney, Agent, or Firm*—Sachs & Sachs

[57] ABSTRACT

An acupressure apparatus for applying vibrational pressure evenly to a plurality of preselected points on a shaded portion of a living body such as upon the face thereof includes a housing and a flexible membrane secured to the housing to form an enclosed chamber between the housing and the flexible membrane for containing therein a liquid. A plurality of protrusions are carried on the flexible membrane and, when the housing is placed adjacent to the shaped portion of the living body, the plurality of protrusions contact preselected acupuncture points. The fluid is excited by vibrational energy such that this energy is transferred to the plurality of protrusions evenly so that the protrusions exert vibrational pressure on the preselected acupressure points. The fluid can be heated if desired.

19 Claims, 3 Drawing Figures

ACUPRESSURE APPARATUS

BACKGROUND AND/OR ENVIRONMENT OF THE INVENTION

1. Field of the Invention

The present invention relates to acupressure apparatuses, and more particularly to an acupressure apparatus which simultaneously stimulates, with even pressure, several acupressure points on a shaped portion of a living body.

2. Description of the Contemporary and/or Prior Art

Acupressure is the application of localized pressure to acupuncture points on the human body to achieve beneficial results. Acupressure techniques based on acupuncture principles find application for facial massages that will effectively eliminate wrinkles. Additionally, acupressure can find use in treating pain in various body surfaces such as the neck, low back, knee, or elbow. When using such acupressure technique, it is desirable to place pressure siumltaneously at numerous acupuncture points wherein the pressure is substantially the same at each discrete point.

Vibration apparatuses are known in the prior art which provide vibration to a substantially flat array of protrusions. Such apparatuses are shown in U.S. Pat. No. 1,141,373 to Behm issued on June 1, 1915; U.S. Pat. No. 3,096,757 issued to T. C. Berard on July 9, 1963; and U.S. Pat. No. 3,585,990 to Blanchy on June 22, 1971. A primary disadvantage of such apparatuses is that they cannot contour to the shape of a body surface, such as the face of the user. Therefore, pressure cannot be simultaneously exerted on the desired acupuncture points in a substantially even manner.

In an attempt to solve the problem of accommodating a contoured body surface, U.S. Pat. No. 4,052,981 issued to R. J. Bachmann on Aug. 3, 1976 teaches a massaging apparatus which includes a plurality of pliable fingers disposed inside a tapered mask. However, because of the wide variance in facial sizes and shapes, this apparatus will not be useful for people other than those few which have facial features substantially in conformance to the shape of the mask. A heat vibrator which includes a plurality of resiliently mounted fingers is shown in U.S. Pat. No. 3,763,853 issued to Jochimski on Oct. 9, 1973. Similarly, the contact such resiliently mounted fingers can exert is dependent upon the configuration of the envelope structure thereof and is mechanically limited by the physical constraints of the apparatus used to mount the resilient fingers.

Several vibrator type apparatuses have been designed which can conform to variously contoured body features. U.S. Pat. No. 1,795,893 issued to Rosett on Mar. 10, 1931 discloses a face mask which includes a helmet like structure having a plurality of rubberized tubes disposed therein. The tubes are inflated and contact the head of the user roughly conforming in shape thereto. Other vibrators such as those shown in U.S. Pat. No. 2,347,554 issued to Gothers on Apr. 25, 1944; U.S. Pat. No. 3,478,736 issued to Roberts on Nov. 18, 1969; U.S. Pat. No. 3,557,781 issued to Kaye on Jan. 26, 1971; and U.S. Pat. No. 4,106,500 issued to Burchart on Aug. 15, 1978 show the use of a foam material to contact and conform to a shaped body surface through the use of a foam padding or the like. While these apparatuses do conform to a given shape, they are not suitable for use as acupressure devices since they do not stimulate discrete acupuncture points, but rather entire body surfaces. Additionally, the vibration transferred is abated in many locations as a result of the presence of uncompressed foam as compared to the foam compressed as a result of contouring.

The present invention overcomes the problems associated with the prior art by providing an apparatus which permits the application of substantially even pressure to a plurality of discrete preselected acupressure points located on a shaped body surface. This is accomplished through the use of a device that includes a water backed membrane carrying a plurality of protrusions such that the water aids the shaping of the membrane to a shaped body surface and also serves to substantially evenly transmit vibration delivered to the water to all of the protrusions carried by the flexible membrane.

SUMMARY OF THE INVENTION

Therefore, a primary object of the present invention is to provide an apparatus which will simultaneously deliver substantially even pressure to a plurality of preselected acupuncture points.

A further object of the present invention is to provide an acupressure apparatus which conforms substantially to the shaped portion of a body which is to be treated thereby.

A still further object of the present invention is to provide an acupressure apparatus which employs a hydraulic principle to permit even distribution of vibrational pressure to selected acupuncture points.

Still another object of the present invention is to provide an acupressure apparatus ideally suited for configuration as a face mask for delivering facial massages.

Another further object of the present invention is to provide an acupressure apparatus which can be used by individuals conveniently at home without attendance of medical personnel.

Still another further object of the present invention is to provide an acupressure apparatus which can be employed at various parts of the patient's body while the patient can assume one of many comfortable positions.

An additional object of the present invention is to provide an acupressure apparatus which can be employed in treating facial wrinkles.

Still another additional object of the present invention is to provide an accupressure apparatus which can simultaneously deliver heat as well as pressure.

Another still further additional object of the present invention is to provide an acupressure apparatus which, when in a facial mask configuration, does not impede the respiration of the user.

Still another further additional object of the present invention is to provide an acupressure apparatus which is simple in design, inexpensive to manufacture, rugged in construction, easy to use, relatively inexpensive, and efficient in operation.

These objects, as well as further objects and advantages, of the present invention will become readily apparent after reading the ensuing description of a nonlimiting illustrative embodiment and viewing the accompanying drawings.

An acupressure apparatus for applying vibrational pressure substantially evenly to a plurality of preselected points on a shaped portion of a living body comprises, according to the principles of the present invention, a housing; a flexible membrane fixedly secured to the housing so as to form an enclosed chamber between the housing and the flexible membrane for containing a liquid disposed within the chamber; a plurality of protrusions carried by the flexible membrane for contacting the preselected points when in proximity thereto; and means for exciting the liquid with vibrational energy, the exciting of the liquid causing the plurality of protrusions to exert vibrational pressure on the preselected points.

BRIEF DESCRIPTION OF THE DRAWING

In order that the present invention may be more fully understood, it will now be described, by way of example, with reference to the accompanying drawings in which.

DESCRIPTION OF THE PREFERRED EMBODIMENT

Figure 3:
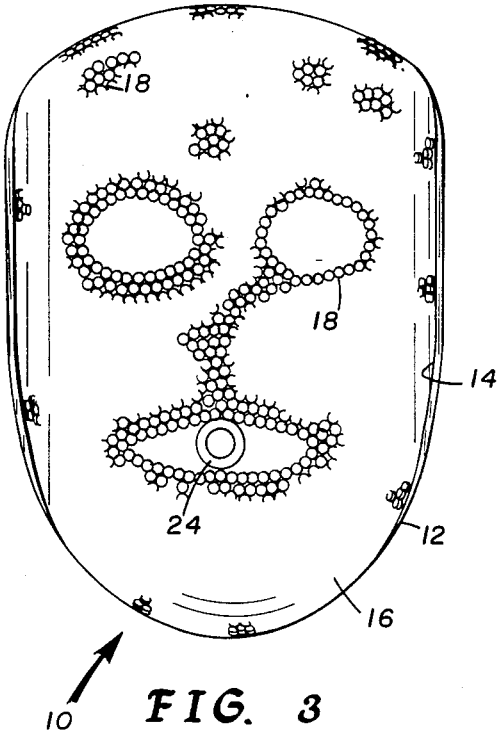
FIG. 3 is a rear view in elevation of an acupressure mask embodying certain features of the present invention.
Figure 2:
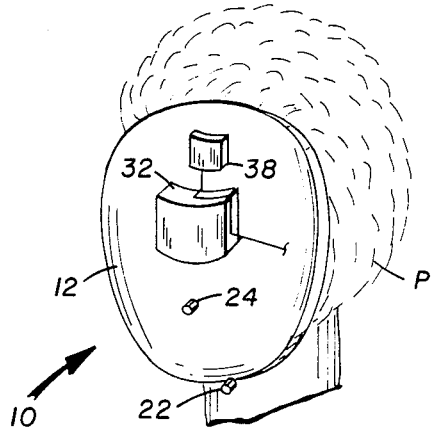
FIG. 2 is a pictorial representation of an acupressure mask constructed in accordance with the principles of the present invention in use.
Figure 1:
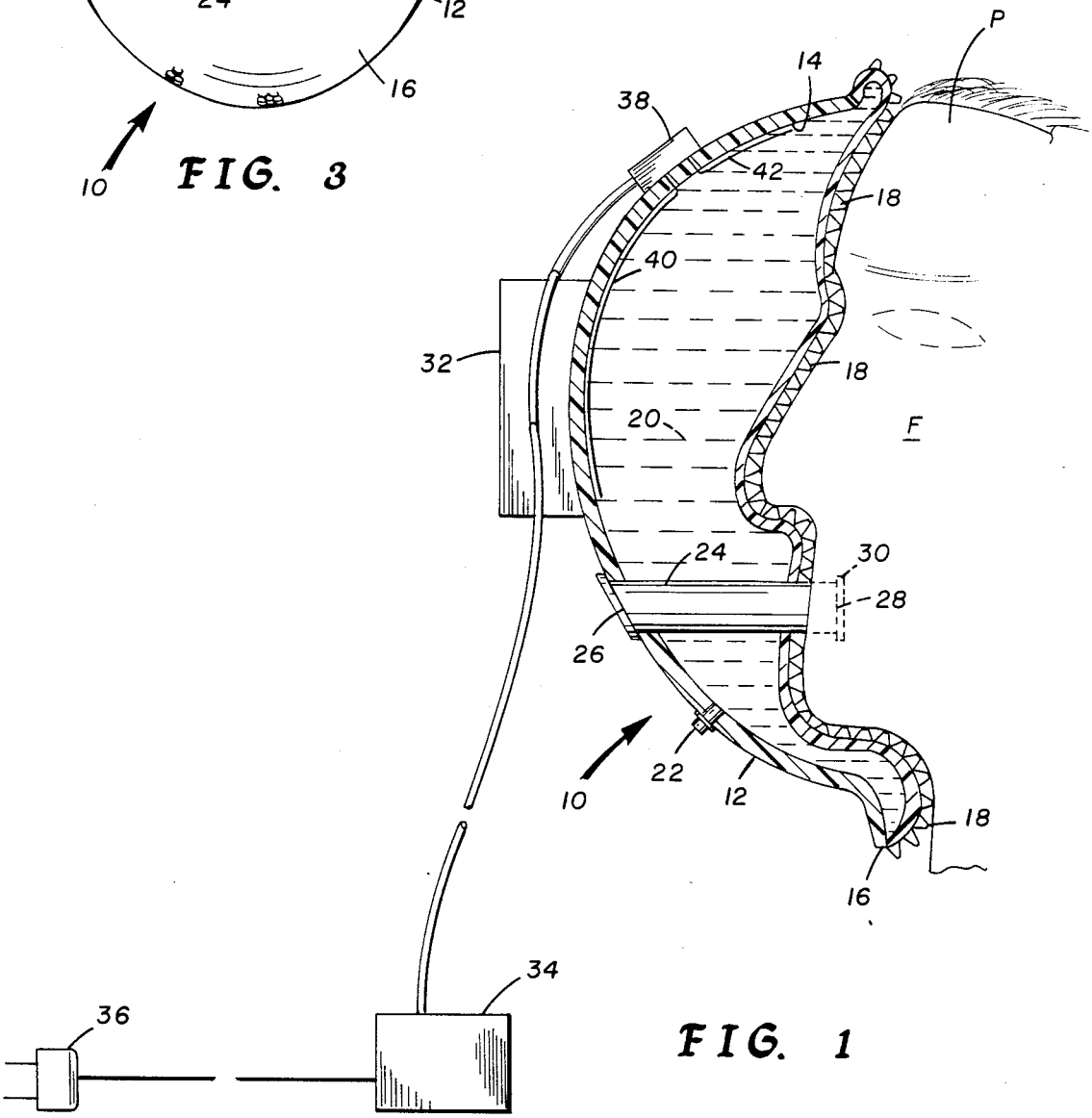
FIG. 1 is a cross sectional view of an acupressure mask constructed in accordance with the principles of the present invention in use by a patient.

Referring now to the figures, there is illustrated therein an acupressure mask 10 constructed in accordance with the principles of the present invention. The ensuing description of the acupressure mask 10 is meant to be but one possible configuration for employing the general principles of the present invention and it is to be understood that apparatuses other than a mask can be constructed incorporating the present teachings for treatment of different parts of the body such as the neck, lower back, knee, and elbow.

The essential feature of the present invention, in any possible embodiment, is the provision of a plurality of discrete protrusions carried on a flexible membrane that can be shaped to a contoured body surface. The flexible membrane is backed by a contained volume of fluid with vibrational energy being supplied to the fluid so that it can be substantially evenly transferred to the protrusions for contact with a plurality of selected acupuncture points. Keeping this general principle in mind, the specific embodiment of the mask 10 will be described.

The mask 10 includes a mask or housing 12 which is contoured so as to be generally similar to the face F of the patient P so that the mask 10 can accept the face F in an open ended chamber 14 formed thereby. The mask plate is preferably constructed of a rigid material such as metal or plastic. A flexible membrane 16 is fixedly secured to the mask plate 12 so as to close the open ended chamber 14 thereof, thereby forming a liquid tight compartment. The flexible membrane 16 can be constructed of various flexible materials such as from elastomer compounds or flexible plastics and has carried thereon a plurality of protrusions 18. The protrusions 18 can be integrally molded with the flexible membrane 16 or can be bonded thereto using techniques well known in the art. The protrusions 18 are blunt ended and are substantially frustoconical in shape as illustrated. This particular configuration is ideal for discretely contacting the various acupuncture points that are disposed under the skin of a surface of a human body.

The open ended chamber 14, essentially sealed by the flexible membrane 16, is filled with a liquid 20. The liquid 20 can comprise water, oil, or another suitable liquid. When the mask 10 is brought proximate to the face F of the patient P, the membrane 16 contours to the facial characteristics of the patient P as aided by the presence of the liquid 20. By virtue of a simple hydraulic principle, the pressure along the membrane 16 will be equalized as the mask 10 is firmly pushed against the face F of the patient P. A fill plug 22 is provided on the mask plate 12 to facilitate filling of the chamber 14 with the liquid 20. Of course, the mask 10 could be filled and sealed at the time of manufacture or can be filled at the point of use as desired.

Since there are no acupuncture points on the eyes or mouth, the portions of the flexible membrane 16 which fall adjacent to these features are not provided with protrusions 18 as illustrated in FIG. 3. Similarly, in other configurations of the present invention designed to treat body portions other than the face, areas can be provided without protrusions, as desired, to create zones that are not subject to pressure.

To facilitate the breathing of the patient P, an open ended tube 24 is provided which is mounted on the mask plate 12. The open ended tube 24 opens at one end 26 thereof through the mask plate 12 to permit the passing of air therethrough. The other end 28 of the tube 24 is similarly open and is provided with a flange 30 that can be engaged by the mouth and teeth of the user to maintain the proper position of the tube 24 which serves as an airway for respiration of the patient P. The flexible membrane 16 is sealed to the outer surfaces of the tube 24, where it passes therethrough, to contain the liquid 20. The liquid 20 is excited by vibrational energy delivered by a vibrator 32 fixedly secured to the mask plate 12. The vibrator, as illustrated, is of the electrical type and operates from a step down transformer 34 adapted to be powered by insertion of an electrical plug 36 into a conventional electrical outlet. The step down transformer provides a safe, low voltage to the vibrator 32 and is sufficiently isolated from the power supply for safety considerations. The vibrator causes transmission of vibrational energy through the mask 10 to the liquid 20, and, because of the selected design of the vibrator 32, such radiation is substantially uniform throughout the liquid 20.

Instead of being electrically powered, the vibrator can be of the mechanical wind up type or, if electrically powered, it can be powered by a battery rather than a transformer.

To further enhance the acupressure action of the present invention, it is desirable to heat the liquid 20 by suitable heater means. Such heating can be accomplished by heating the liquid outside the mask 10 and then supplying the heated liquid to the mask 10 prior to use. Alternately, the mask could be filled with the liquid 20 and, and if the mask was constructed of suitable materials, the mask could be placed in a microwave oven for heating.

Still another heating means is illustrated in the drawing in the form of a heater 38 mounted on the mask plate 12. The heater 38 is electrically connected to the step down transformer 34 and includes a heating element 40 disposed in the liquid 20 and a thermostat 42 similarly disposed in the liquid 20. The heater 38 acts in a conventional manner to achieve a preselected temperature for liquid 20.

The volume of liquid disposed in the mask 10 can be varied as desired by the user to optimize the contouring of the flexible membrane 16 to a particular individual. In addition, the edges of the mask plate 12 can be padded for comfort.

The preferred position for use of the present invention for a facial treatment would put the patient P in a face-up horizontal position with the mask 10 resting on the face F of the patient P and being held in place by gravity. Alternately, suitable straps or other similar fasteners can be provided to position the mask 10 on the face F of the patient P and such a technique can also be used if devices for other than the face of a patient are constructed within the principles of the present invention. For instance, an apparatus which straps to the neck, or lower back can be employed or, an apparatus incorporating the principles of the present invention for treating such areas of the body can be held in place by gravity.

It will be understood that various changes in the details, materials, and arrangements of parts and operational conditions which have been herein described and illustrated in order to explain the nature of the invention may be made by those skilled in the art within the principles and scope of the present invention.

Having thus set forth the nature of the invention, what is claimed is:

1. An acupressure apparatus for applying vibrational pressure substantially evenly to a plurality of preselected points on a shaped portion of a living body comprising:

a rigid housing;

a flexible membrane fixedly secured to said housing so as to form an enclosed chamber between said housing and said flexible membrane for containing a liquid when disposed within said chamber;

a plurality of protrusions carried by said flexible membrane for contacting said preselected points when in proximity thereto; and means for exciting said liquid with vibrational energy, the exciting of said liquid causing said plurality of protrusions to exert said vibrational pressure on said preselected points.

2. An acupressure apparatus in accordance with claim 1, further comprising means for heating said liquid.

3. An acupressure apparatus in accordance with claim 1, wherein said protrusions are blunt ended.

4. An acupressure apparatus in accordance with claim 1, wherein said exciting means comprises a vibrator mounted to excite said liquid.

5. An acupressure apparatus in accordance with claim 1, wherein said chamber is contoured to conform generally to said shaped portion of said living body.

6. An acupressure mask for applying vibrational pressure substantially evenly to a plurality of preselected points on the face of the user comprising:

a rigid mask plate contoured to form an open ended chamber to accept said face therein;

a flexible membrane fixedly secured on said mask plate over said open end thereof so as to close said chamber;

a liquid disposed within said chamber;

a plurality of protrusions carried by said flexible membrane for contacting said preselected points when said mask plate is disposed over said face; and means for exciting said liquid with vibrational energy, the exciting of said liquid causing said plurality of protrusions to exert said vibrational pressure on said preselected points.

7. An acupressure mask in accordance with claim 6, further comprising means for facilitating respiration of the user.

8. An acupressure mask in accordance with claim 7, wherein said respiration facilitation means comprises an open ended tube disposed through said mask plate, said chamber and said flexible membrane, the end of said tube extending through said flexible membrane being disposed proximate to the mouth of said user.

9. An acupressure mask in accordance with claim 8, wherein said tube further comprises a flange disposed on said end thereof adjacent to the mouth of said user, said flange facilitating the engagement of said tube by said user.

10. An acupressure mask in accordance with claim 6, further comprising means for heating said liquid.

11. An acupressure mask in accordance with claim 10, wherein said heating means comprises an electrical resistance heater having a heating element operably disposed to heat said liquid within said chamber.

12. An acupressure mask in accordance with claim 11, wherein said electrical resistance heater is thermostatically controlled.

13. An acupressure mask in accordance with claim 6, wherein said plurality of protrusions are arranged in a selected pattern on said flexible membrane except in the areas of said flexible membrane which are disposed adjacent to the eyes and mouth of the user when said mask is disposed on the face of the user in a use position.

14. An acupressure mask in accordance with claim 6, wherein each of said plurality of protrusions is blunt ened.

15. An acupressure mask in accordance with claim 14, wherein each of said plurality of protrusions is frustoconical in shape.

16. An acupressure mask in accordance with claim 6, wherein said exciting means comprises a vibrator mounted to excite said liquid.

17. An acupressure mask in accordance with claim 16, wherein said vibrator is electrically powered.

18. An acupressure mask in accordance with claim 6, further comprising a sealable fill port in communication with said open ended chamber for permitting the ingress and egress of said liquid relative to said open ended chamber.

19. An acupressure mask in accordance with claim 6, wherein said mask plate is substantially rigid.

* * * * *